US005110305A

United States Patent [19]

Edgley et al.

[11] Patent Number: 5,110,305

[45] Date of Patent: May 5, 1992

[54] SHROUD DEVICE FOR ELECTRICAL CONDUCTORS

[75] Inventors: Richard R. Edgley, Elmhurst; Daniel M. Palmieri, Bloomingdale; Timothy R. Ponn, Aurora, all of Ill.

[73] Assignee: Molex Incorporated, Lisle, Ill.

[21] Appl. No.: 667,727

[22] Filed: Mar. 11, 1991

[51] Int. Cl.[5] ..... H01R 4/24

[52] U.S. Cl. ..... 439/441; 439/495; 439/736

[58] Field of Search ..... 439/492–499, 439/67, 77, 736, 930, 604, 438–441

[56] References Cited

U.S. PATENT DOCUMENTS

| | | | |
|---|---|---|---|
| 3,137,537 | 6/1964 | Cole et al. | 439/493 |
| 3,939,393 | 2/1976 | Nagasaki et al. | 439/736 |
| 4,392,703 | 7/1983 | Hall et al. | 439/930 |
| 4,705,482 | 11/1987 | Endo et al. | 439/492 |
| 4,713,020 | 12/1987 | Awano et al. | 439/495 |
| 4,769,906 | 9/1988 | Purpura et al. | 439/604 |
| 4,802,866 | 2/1989 | Balzano et al. | 439/496 |
| 4,978,315 | 12/1990 | Edgley et al. | 439/441 |

*Primary Examiner*—David L. Pirlot

*Attorney, Agent, or Firm*—A. A. Tirva; Stephen Z. Weiss

[57] ABSTRACT

A device is disclosed for facilitating insertion of an exposed conductive element, such as an exposed wire end of an electrical cable, into an electrical connector in termination with a terminal in the connector. The device is in the form of a shroud of insulating material secured to an insulating portion of the conductive element and substantially surrounding a conductor portion of the conductive element. The shroud is configured to allow the conductor portion to be inserted into the connector in termination with the terminal therein. In the preferred embodiment, the shroud is insert molded to the insulating portion of the conductive element.

6 Claims, 2 Drawing Sheets

SHROUD DEVICE FOR ELECTRICAL CONDUCTORS

FIELD OF THE INVENTION

This invention generally relates to the art of electrical connectors and, particularly, to a shroud device for facilitating insertion of a conductive element into an electrical connector.

BACKGROUND OF THE INVENTION

There are a variety of electrical connectors in which a conductive element, such as an exposed wire of an electrical cable, is inserted into an electrical connector in termination with a terminal in the connector. There are a variety of problems encountered with such systems.

For instance, such exposed conductive elements can come into contact with a conductive surface and create shorting problems. Fires have been known to be caused during television repairs as a result of shorting the exposed ends of power leads from an electrical cable. In addition, unprotected exposed conductive elements can become bent or damaged and, thereby, interfere with or totally prevent insertion of the elements into a complementary connector. Even simple misalignment can interfere with connector termination. These problems are particularly present when the system incorporates a multi-conductor electrical cable, such as a flat ribbon cable wherein the spacing and alignment of the exposed ends of the multiple conductive wires is critical.

An example of an electrical connector which might be susceptible to such problems is shown in patent application Ser. No. 501,577 to Harwath, et al., filed Mar. 30, 1990 and assigned to the assignee of this invention. A new and improved multiple-conductor electrical connector is disclosed therein as having stamped and formed contacts and which is particularly adapted for mounting on a printed circuit board which includes rows of staggered insertion holes. The connector is provided for gang-loading of the contacts, and the contacts are adapted for low insertion and high retention forces on the inserted conductive elements. Connectors of this type commonly are termed "wire traps". In other words, the exposed ends of conductive wires of an electrical cable are inserted directly into the connector in termination with and trapped by the contacts or terminals within the connector. That particular connector is designed for terminating the conductors of a flat ribbon electrical cable. For purposes apparent hereinafter, that application is incorporated herein by reference.

This invention is directed to solving the above problems and providing a new and improved, extremely simple but very effective device for facilitating insertion of exposed conductive elements into electrical connectors.

SUMMARY OF THE INVENTION

An object, therefore, of the invention is to provide a shroud device for facilitating insertion of an exposed conductive element into an electrical connector in termination with a terminal or contact in the connector.

In the exemplary embodiment of the invention, the conductive element is illustrated as an electrical cable having one or more wires with insulating portions and conductor portions. A shroud of insulating material is secured to the insulating portion(s) and substantially surrounds the conductor portion(s) of the conductive element. The shroud is of a configuration to allow the conductor portion(s) of the conductive element to be inserted into the connector in termination with the terminal(s) therein. In the preferred embodiment, the means for securing the shroud to the insulating portion of the conductive element is by insert molding the shroud to the insulating portion of the conductive element.

In many wire trap connectors, the terminals have release portions, such as a spring finger, for releasing the trapped wires. Often, the connector itself has an actuating portion, such as a cover, movably mounted on the connector for moving the spring finger and releasing the trapped wire. It is contemplated that the novel shroud device of this invention be provided with a window through which access is provided to the actuating means of the connector to release the trapped wire or wires.

Another feature of the invention is the provision of simple polarizing means on the shroud to ensure proper insertion of the conductive element into the electrical connector in termination with the terminal therein. In the exemplary embodiment, the polarizing means is provided simply by an offset positioning of the conductive element or elements whereby the conductive elements cannot be inserted into the connector unless the shroud is properly positioned.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the following description taken in conjunction with the accompanying drawings, in which like reference numerals identify like elements in the figures and in which:

DETAILED DESCRIPTION OF THE PREFERRED EMBODIMENT

Figure 1:
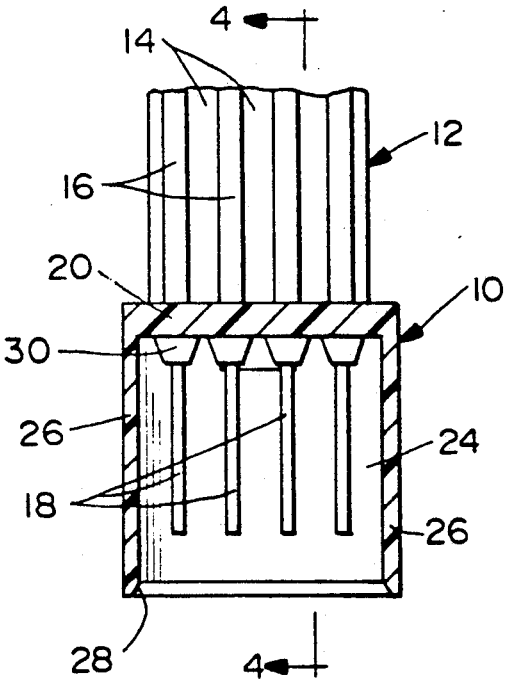
FIG. 1 is a vertical section through the shroud device of the invention, secured to the insulating material of a flat ribbon cable and surrounding exposed ends of the conductor wires of the cable.
Figure 2:
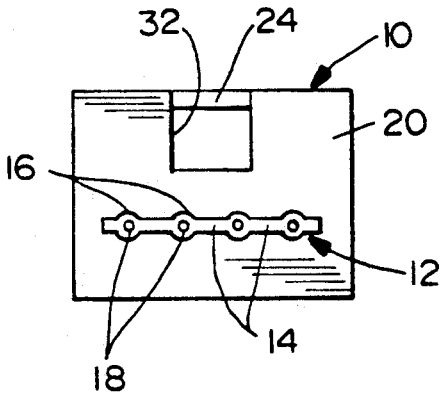
FIG. 2 is a top plan view of the device as illustrated in FIG. 1.
Figure 3:
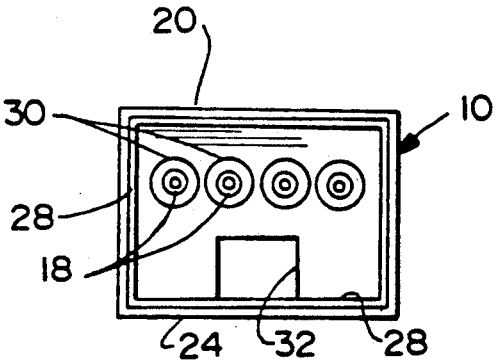
FIG. 3 is a bottom plan view of the device as illustrated in FIG. 1.

Referring to the drawings in greater detail, and first to FIGS. 1-4, the invention is illustrated in the form of a shroud device, generally designated 10, for securing to a flat ribbon electrical cable, generally designated 12.

As is known in the art, ribbon cable 12 is generally flexible in its flat plane and includes insulating material 14 forming webs between generally cylindrical, integral jackets 16 which surround a plurality of conductive wires, the exposed ends 18 of which are shown projecting from the insulating material. In essence, the ribbon cable is formed by a plurality of discrete conductive wires which are generally parallel and in a flat plane, with the insulating material being integral about the entire multi-conductor cable.

As stated above, various problems are encountered in systems incorporating exposed conductors, whether the system involves a single exposed electrical wire or a multi-conductor cable such as ribbon cable 12 illustrated herein. The exposed wire or wires can short on engagement with conductive surfaces creating dangerous situations, or the exposed wire or wires can become bent or damaged causing difficulties in terminating the conductive element with a complementary electrical connector.

Shroud 10 is designed to solve these problems, along with providing other useful features in conjunction with a mating or complementary connector.

More particularly, as seen in the drawings, shroud 10 is generally box-shaped with a top wall 20, a front wall 22, a rear wall 24 and a pair of side walls 26, all of which form an open bottom or mouth 28 for positioning over a complementary connector as described hereinafter. The shroud is integrally molded of insulating material, such as plastic or the like.

Figure 4:
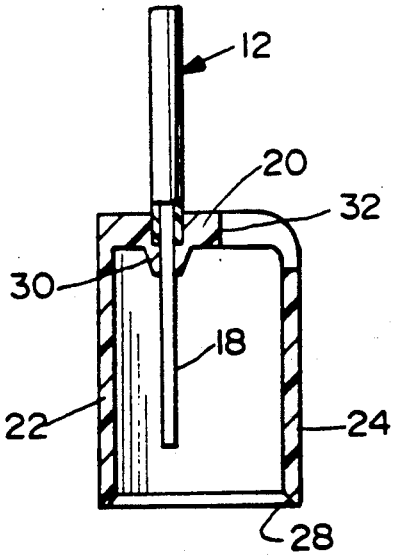
FIG. 4 is a vertical section taken generally along line 4—4 of FIG. 1.

Means are provided for securing shroud 10 to the insulating material of cable 12. In the preferred embodiment, this means is provided by insert molding the shroud to the insulating material of the cable. Of course, other means are contemplated such as heat welding, appropriate adhesives or the like. As seen in FIG. 4, the shroud may be molded with interior bosses 30 for surrounding upper portions of exposed conductor ends 18 to provide some rigidifying support therefor. A window 32 is provided at the juncture of top wall 20 and rear wall 24 for purposes described hereinafter. Lastly, it can be seen in FIGS. 2–4 that the ribbon cable and its exposed conductors 18 are offset (i.e., closer to front wall 22 than back wall 24 of the shroud), for polarizing purposes in relation to the complementary connector described hereinafter.

Figure 5:
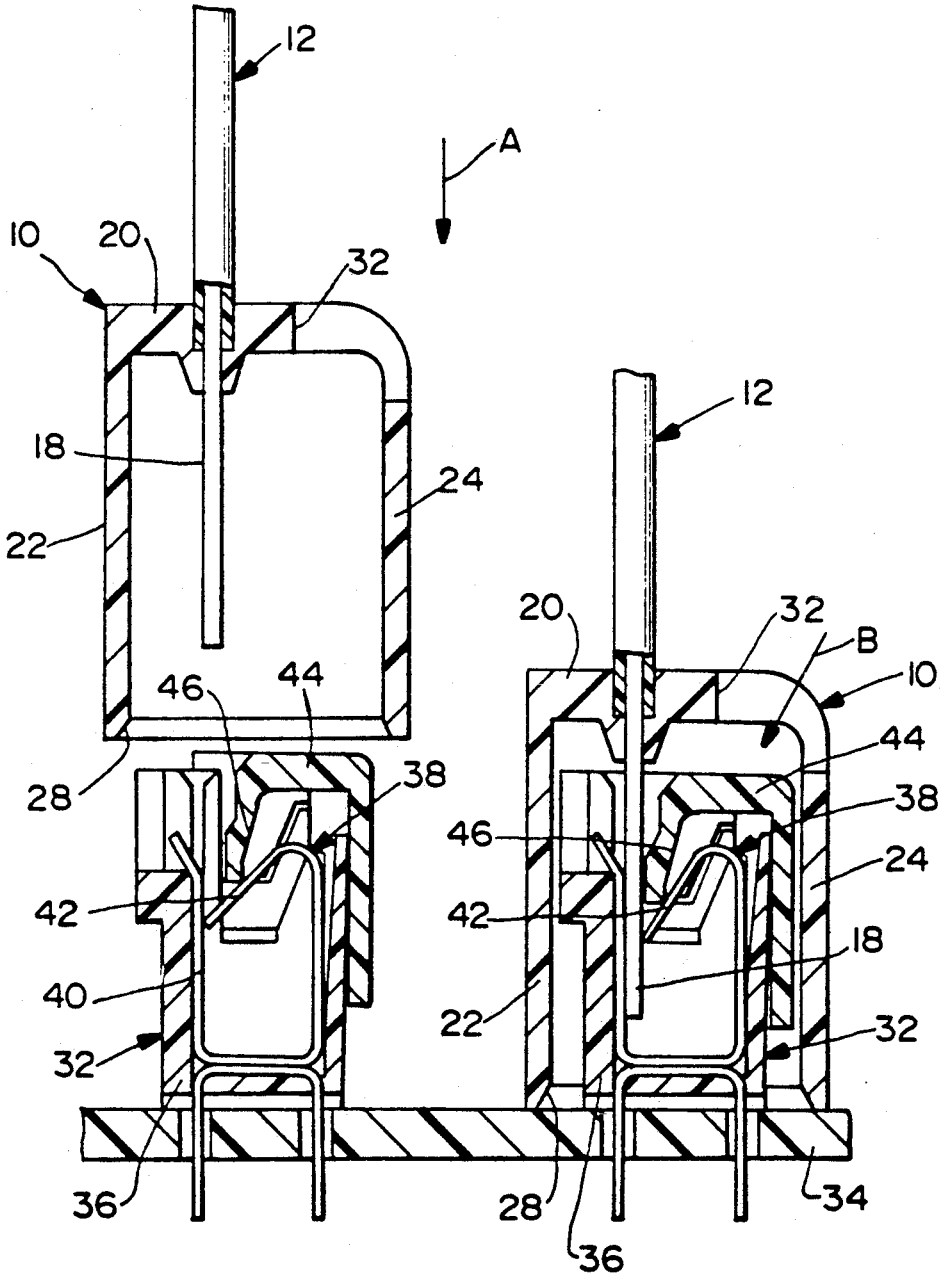
FIG. 5 is a vertical section (similar to that of FIG. 4) through a pair of shroud devices secured to a pair of ribbon cables and in conjunction with a pair of electrical connectors mounted to a printed circuit board, the right-hand shroud being in terminating position relative to the respective connector and the left-hand shroud being illustrated as about to be positioned over the left-hand connector to terminate the conductors.

FIG. 5 shows a pair of shrouds 10 and cables 12 in conjunction with a pair of electrical connectors, generally designated 32, the connectors being mounted to a printed circuit board 34. These connectors will not be described in considerable detail because they are substantially identical to the connector shown in the aforesaid application Ser. No. 501,577 which is incorporated herein by reference. Suffice it to say, each connector includes a housing 36 within which are mounted a plurality of electrical contacts, generally designated 38, the number of contacts being appropriate for the number of conductors in ribbon cable 12. Each contact has an anvil portion 40 and a spring finger portion 42 between which a respective exposed conductor 18 is trapped on insertion therebetween in the direction of arrow "A". In order to release the conductors, a cover 44 is movably mounted on housing 36 for movement in the direction of arrow "A" whereby a flange 46 of the cover engages spring finger 42 to move the spring finger away from anvil 40 and release the conductors whereby shroud 10 and cable 12 can be disconnected from the connector.

It can be seen by the left-hand shroud 10 shown in FIG. 5 that the walls of the shroud surround exposed ends 18 of the ribbon cable wires or conductors. This protects the wires from becoming bent or damaged which might preclude proper insertion of the wires into the respective electrical connector 32 in termination with contacts or terminals 38. In addition, the shroud prevents engagement of the wires with any conductive surfaces which might short the wires.

The right-hand shroud 10 is shown in FIG. 5 with the conductive wires of cable 12 fully inserted into the right-hand connector 32 in termination with terminals 38. This depiction shows that window 32 is in alignment with cover 44 of the surrounded connector. Therefore, access is provided through the shroud to the cover, as indicated by arrow "B", whereby the cover can be depressed against the terminals to release the trapped wires. In addition, by using the shroud in conjunction with an electrical connector wherein the wire insertion holes of the connector are offset relative to a center-line of the connector, very simple polarizing means are provided by configuring the walls of the shroud to substantially embrace the outside bounds of the connector. Consequently, ribbon cable 12 and exposed wires 18 also are offset to align the exposed wires with the insertion holes into the connector and the wire trap terminals therein as well as providing polarization of the connector.

Still further, it can be seen that the height of shroud 10, as provided by walls 22–24, is such that the bottom of the shroud about mouth 28 abuts against the top of printed circuit board 34 when wires 18 are fully inserted in proper termination with terminals 38. Consequently, the shroud itself is used to prevent over insertion of the cable into the connector which itself could damage the distal ends of the exposed wires which, in turn, might interfere with subsequent connections between the cable and the connector.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. A system for facilitating insertion of an electrical cable into an electrical connector, the cable having at least one conductive wire surrounded by an insulating jacket, and an end of the wire being stripped of the jacket for termination with a terminal in the connector, comprising in combination:

an electrical connector having a terminal for trapping the stripped end of the wire, with actuating means movably mounted on the connector for engaging the terminal to release the trapped wire; and a shroud of insulating material secured to the insulating jacket of the cable and substantially surrounding the stripped end of the wire and configured to allow the wire to be inserted into the connector in termination with the terminal, the shroud having a window providing access through the shroud to the actuating means of the connector.

2. The system of claim 1 wherein said shroud is insert molded to the insulating jacket o the cable.

3. A system for facilitating insertion of an electrical cable into an electrical connector, the cable having at least one conductive wire surrounded by an insulating jacket, and an end of the wire being stripped of the jacket for termination with a terminal in the connector, comprising in combination:

an electrical connector mounting a terminal for termination with the conductive wire in response to the wire being inserted into the connector, the connector being adapted for mounting to a printed circuit board, and the connector having a given height projecting from the printed circuit board; and a shroud of insulating material secured to the insulating jacket of the cable substantially surrounding the stripped end of the wire and configured to allow the wire to be inserted into the connector in termination with the terminal, and the shroud having means for abutting the printed circuit board when the wire is properly inserted into the connector to prevent over insertion of the wire thereinto.

4. The system of claim 3 wherein said shroud has wall means defining an open mouth for positioning over the connector, the wall means being of a length for abutting the printed circuit board to prevent said over insertion of the wire into the connector.

5. The system of claim 3 wherein said shroud is insert molded to the insulating jacket of the cable.

6. A system for facilitating insertion of an electrical cable into an electrical connector, the cable having at least one conductive wire surrounded by an insulating jacket, and an end of the wire being stripped of the jacket for termination with a terminal in the connector, comprising in combination:

an electrical connector mounting a terminal for termination with the stripped wire when the wire is inserted into the connector, the connector having an insertion hole offset relative to a center line of the connector; and a shroud of insulating material insert molded to the insulating jacket of the cable substantially surrounding the stripped end of the wire and configured to allow the wire to be inserted into the connector in termination with the terminal, the cable being offset relative to a center line of the shroud complementary to the offsetting of the insertion hole of the connector to provide a polarizing means between the shroud and the connector.

* * * * *